US010691045B1

(12) United States Patent
Ogishima

(10) Patent No.: US 10,691,045 B1
(45) Date of Patent: Jun. 23, 2020

(54) ROLL AND IMAGE FORMING APPARATUS

(71) Applicant: FUJI XEROX CO., LTD., Tokyo (JP)

(72) Inventor: Kazuya Ogishima, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 16/514,194

(22) Filed: Jul. 17, 2019

(30) Foreign Application Priority Data

Mar. 29, 2019 (JP) ..... 2019-068138

(51) Int. Cl.
*G03G 15/16* (2006.01)

(52) U.S. Cl.
CPC ..... *G03G 15/162* (2013.01); *G03G 15/1615* (2013.01); *G03G 2215/1614* (2013.01); *G03G 2215/1619* (2013.01)

(58) Field of Classification Search
CPC ..... G03G 15/162; G03G 15/1615; G03G 2215/1614; G03G 2215/1619
See application file for complete search history.

(56) References Cited

U.S. PATENT DOCUMENTS 5,241,343 A * 8/1993 Nishio ..... G03G 15/0233 399/90
5,489,974 A * 2/1996 Kamaji ..... G03G 13/08 399/284
10,234,794 B2 3/2019 Imai et al.
2014/0056626 A1* 2/2014 Sakai ..... G03G 15/2017 399/329
2015/0153676 A1* 6/2015 Masuyama ..... B29C 43/36 264/241
2016/0018767 A1* 1/2016 Takada ..... G03G 15/206 399/333

FOREIGN PATENT DOCUMENTS

JP 2005-233991 A 9/2005
JP 2017-009985 A 1/2017

* cited by examiner

*Primary Examiner* — Ryan D Walsh
(74) *Attorney, Agent, or Firm* — Sughrue Mion, PLLC

(57) ABSTRACT

A roll includes an electrically-conductive shaft; an elastic layer provided on the shaft; and a non-electrically-conductive annular unit that is attached to at least one of ends of the shaft that protrude from end surfaces of the elastic layer in a shaft direction while being in contact with the end surface of the elastic layer. A protruding part that protrudes so as to cut into the end surface of the elastic layer is provided on a part of the annular unit that makes contact with the end surface of the elastic layer, and the protruding part has a thickness smaller than a thickness of the part of the annular unit that makes contact with the end surface of the elastic layer.

14 Claims, 14 Drawing Sheets

ROLL AND IMAGE FORMING APPARATUS

CROSS-REFERENCE TO RELATED APPLICATIONS

This application is based on and claims priority under 35 USC 119 from Japanese Patent Application No. 2019-068138 filed Mar. 29, 2019.

BACKGROUND

(i) Technical Field

The present disclosure relates to a roll and an image forming apparatus.

(ii) Related Art

Conventionally, the technique described in Japanese Unexamined Patent Application Publication No. 2017-9985 is known as a technique concerning a roller member or the like in which leakage is hard to occur even upon application of a high voltage.

Japanese Unexamined Patent Application Publication No. 2017-9985 describes a roller member and an image forming apparatus using the roller member as a transfer roller or a transfer opposing roller. The roller member has an elastic layer on an outer circumferential surface of a cored bar that has a protruding part protruding from a range where the elastic layer is provided toward an end in an axial direction and a non-electrically-conductive member made of a non-electrically-conductive material and provided on the protruding part so as to cut into an end surface of the elastic layer at an end in the axial direction.

SUMMARY

Aspects of non-limiting embodiments of the present disclosure relate to providing a roll and an image forming apparatus using the roll. The roll is configured such that at least an elastic layer is provided on an electrically-conductive shaft to which a voltage that can cause discharge can be supplied and a non-electrically-conductive annular unit is attached to an end of the shaft that protrudes from an end of the elastic layer in a shaft direction while being in contact with an end surface of the elastic layer. The roll can suppress occurrence of discharge through a gap that occurs between the annular unit and the elastic layer due to a factor such as passage of time as compared with a case where a protruding part that cuts into the end surface of the elastic layer is not provided on a part of the annular unit that makes contact with the end surface of the elastic layer.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a roll including an electrically-conductive shaft; an elastic layer provided on the shaft; and a non-electrically-conductive annular unit that is attached to at least one of ends of the shaft that protrude from end surfaces of the elastic layer in a shaft direction while being in contact with the end surface of the elastic layer, wherein a protruding part that protrudes so as to cut into the end surface of the elastic layer is provided on a part of the annular unit that makes contact with the end surface of the elastic layer, and the protruding part has a thickness smaller than a thickness of the part of the annular unit that makes contact with the end surface of the elastic layer.

BRIEF DESCRIPTION OF THE DRAWINGS

Exemplary embodiments of the present disclosure will be described in detail based on the following figures, wherein.

DETAILED DESCRIPTION

Exemplary embodiments of the present disclosure are described with reference to the drawings.

First Exemplary Embodiment

Figure 1:
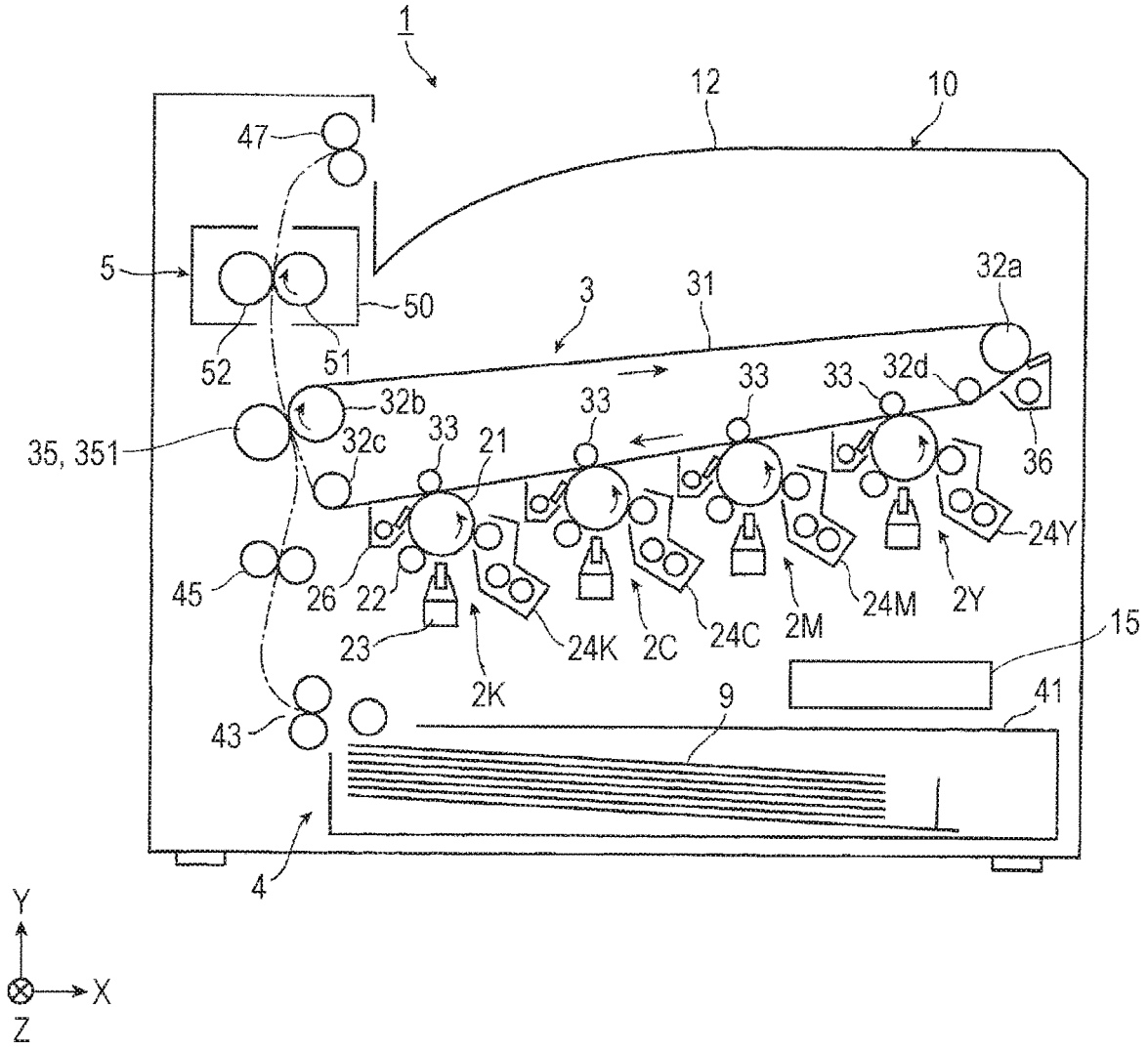
FIG. 1 is a schematic view illustrating a configuration of an image forming apparatus according to a first exemplary embodiment.

FIG. 1 illustrates an image forming apparatus 1 according to a first exemplary embodiment. Arrows X, Y, and Z in FIG. 1 and other drawings indicate width, height, and depth directions assumed in the drawings. The circle in a part where arrows X and Y intersect in FIGS. 1 and 2 and other drawings indicate that the direction indicated by arrow Z points downward perpendicularly to the drawings.

Image Forming Apparatus

The image forming apparatus 1 is an apparatus that forms an image made of toner serving as a developer on a sheet of paper 9 that is an example of a recording medium by an image formation method such as an electrophotographic system. This image forming apparatus 1 is, for example, a printer that forms an image corresponding to image information supplied from an external device such as an information terminal device or an image reading device.

As illustrated in FIG. 1, the image forming apparatus 1 includes, in an internal space of a housing 10 that is an example of an apparatus body, an image formation unit 2 that forms a toner image that is an unfixed image, an intermediate transfer unit 3 that second-transfers the toner image formed by the image formation unit 2 onto the sheet of paper 9 after temporarily holding and transferring the toner image, a paper feeding unit 4 that contains therein the sheet of paper 9 to be supplied to a position of second transfer of the intermediate transfer unit 3 and delivers the sheet of paper 9 out of the paper feeding unit 4, and a fixing unit 5 that fixes the toner image that has been second-transferred by the intermediate transfer unit 3 onto the sheet of paper 9.

The housing 10 is a structured object that is assembled to required structure and shape by using various materials such as support members and exterior materials. The housing 10 has, on a part of an upper surface part, a paper output containing unit 12 in which the sheets of paper 9 discharged after image formation are contained so as to be stacked on one another. The line with alternate long and short dashes in FIG. 1 indicates a major path along which the sheet of paper 9 is transported in the housing 10.

The image formation unit 2 is, for example, constituted by four image formation devices 2Y, 2M, 2C, and 2K for exclusively forming toner images of four colors (yellow (Y), magenta (M), cyan (C), and black (K)), respectively. The four image formation devices 2 (Y, M, C, and K) according to the first exemplary embodiment are arranged so that an image formation device 2 closer to a right side is located higher in the housing 10 illustrated in FIG. 1.

Figure 2:
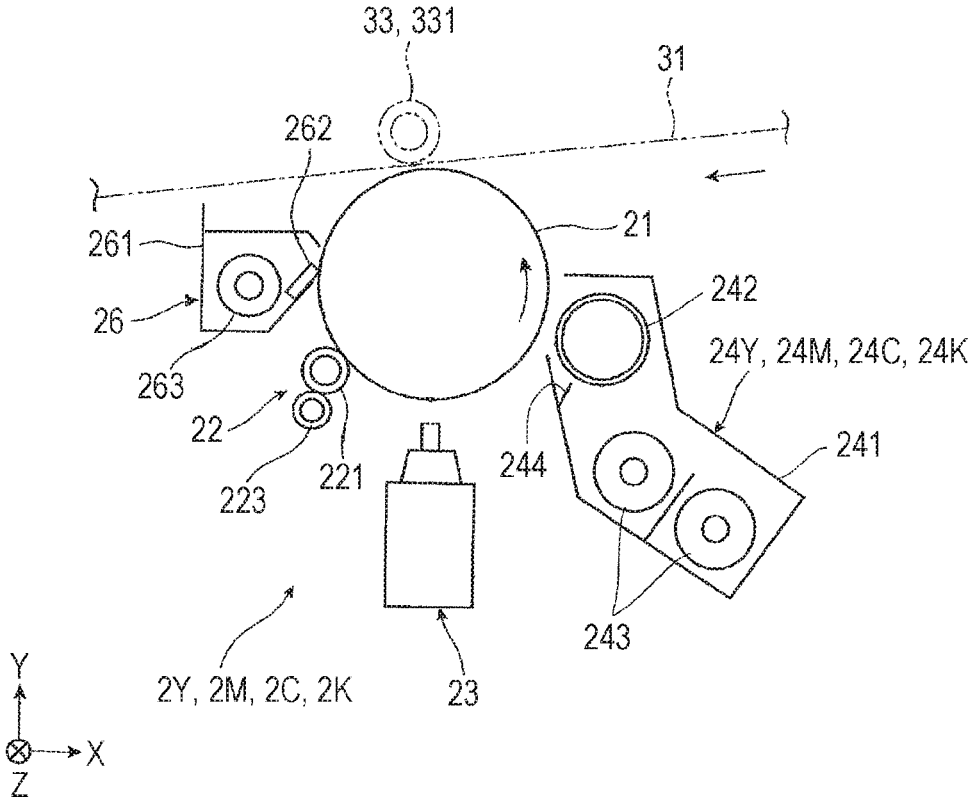
FIG. 2 is a schematic view illustrating a part (mainly an image formation device) of the image forming apparatus of FIG. 1.

Each of the four image formation devices 2 (Y, M, C, and K) has a photoconductor drum 21 that is an example of an image holding unit that rotates in a direction indicated by the arrow as illustrated in FIGS. 1 and 2.

In each of the image formation devices 2 (Y, M, C, and K), devices such as a charging device 22 that charges an image holding region of the photoconductor drum 21, an exposure device 23 that is an example of an exposure unit that forms an electrostatic latent image by performing exposure according to image information on the charged image holding region of the photoconductor drum 21, a developing device 24Y, 24M, 24C, or 24K that forms a toner image by developing an electrostatic latent image formed on an image formation surface of the photoconductor drum 21 by using toner of a corresponding color, and a first cleaning device 26 that cleans the image formation surface of the photoconductor drum 21 are disposed around the photoconductor drum 21.

For convenience of description, in FIG. 1, all of reference signs 21 through 24 and 26 are described as for the image formation device 2K for black (K), and only a certain reference sign is described and remaining reference signs are omitted as for the image formation devices 2Y, 2M, and 2C for the other colors.

The charging device 22 is a contact-charging-type charging device that uses a charging roller 221 that is an example of a contact charging member and performs charging by using a required charging voltage supplied from a power feeding device 15 to the charging roller 221. In FIG. 2, a cleaning roll 223 that cleans a roll surface in contact with the charging roller 221 is further provided.

The developing devices 24 (Y, M, C, and K) have an almost same configuration except for a color (any of the four colors (Y, M, C, and K) of toner in a developer contained in a body (housing) 241. That is, as illustrated in FIG. 2, each of the developing devices 24 (Y, M, C, and K) is configured such that a development roller 242 that holds a developer and transports the developer by rotating so that the developer passes a developing-step region that faces the photoconductor drum 21, a stirring member 243 such as an auger that rotates to transport the developer to the development roller 242 while stirring the developer in the body 241, a layer thickness regulating member 244 that regulates an amount (thickness) of the developer held in the development roller 242, and the like are disposed in the body 241. The development roller 242 performs development by using a required voltage for development supplied from the power feeding device 15.

The intermediate transfer unit 3 is disposed above the image formation devices 2 (Y, M, C, and K) that serve as image formation unit 2 in the housing 10.

The intermediate transfer unit 3 is configured such that devices such as an intermediate transfer belt 31 that receives toner images formed in the image formation devices 2 (Y, M, C, and K) in first transfer and hold the toner images and then rotate to transport the toner images to a position of second transfer on the sheet of paper 9, a first transfer device 33 that first-transfers the toner images formed on the photoconductor drums 21 of the image formation devices 2 (Y, M, C, and K) onto an image holding region of an outer circumferential surface of the intermediate transfer belt 31, a second transfer device 35 that second-transfers the toner images on the intermediate transfer belt 31 onto the sheet of paper 9, and a second cleaning device 36 that cleans the outer circumferential surface of the intermediate transfer belt 31 are disposed.

The intermediate transfer belt 31 is suspended across plural support rolls 32*a* through 32*d* and rotates in a direction indicated by the arrow while sequentially passing the photoconductor drums 21 of the image formation devices 2 (Y, M, C, and K), the second transfer device 35, and the like. The support roll 32*a* is configured as a drive roll, and the support roll 32*b* is configured as a second transfer opposing roll.

As illustrated in FIGS. 1 and 2, the first transfer device 33 is a contact-transfer-type transfer device that performs first transfer by using a first transfer roll 331 that is an example of a contact transfer member by using a required voltage for first transfer supplied from the power feeding device 15 to the first transfer roll 331.

Figure 3:
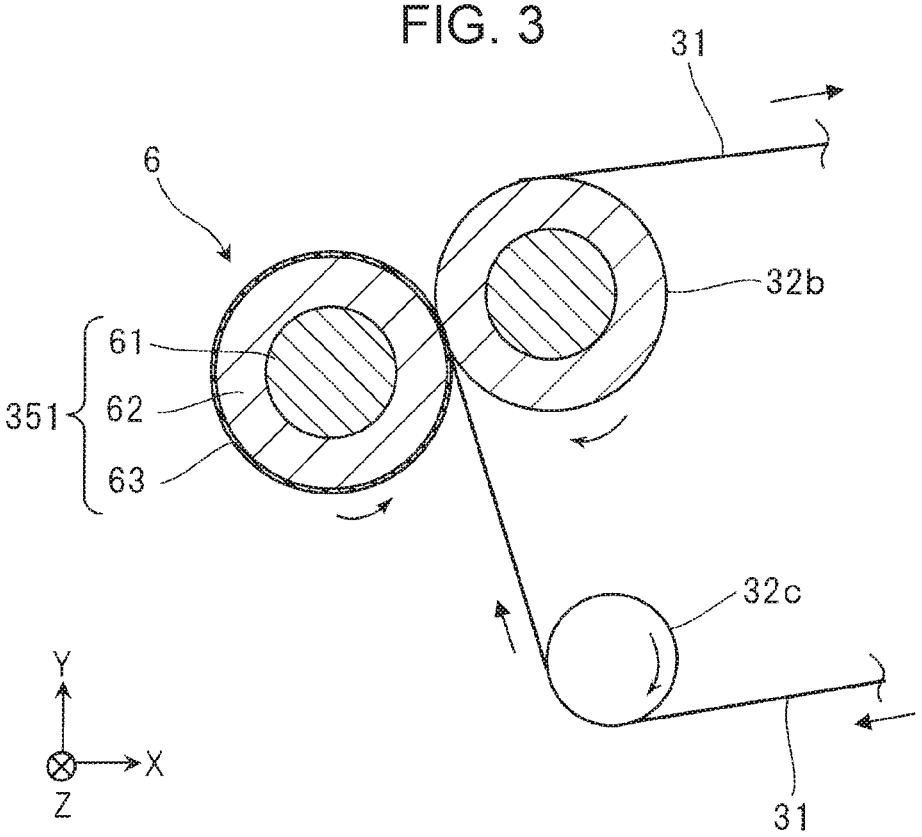
FIG. 3 is a schematic view illustrating another part (mainly a second transfer part) of the image forming apparatus of FIG. 1.

Furthermore, as illustrated in FIGS. 1 and 3, the second transfer device 35 is a contact-transfer-type transfer device that performs second transfer by using a second transfer roll 351 that is an example of a contact transfer member by using a required voltage for second transfer supplied from the power feeding device 15 to the second transfer roll 351.

The paper feeding unit 4 is configured such that devices such as a paper container 41 in which the sheet of paper 9 is contained and a delivery device 43 that delivers the sheet of paper 9 one by one out of the paper container 41 are disposed. The sheet of paper 9 delivered out of the paper feeding unit 4 is transported to a second transfer position between the intermediate transfer belt 31 and the second transfer device 35 in the intermediate transfer unit 3 through a paper feeding transport path constituted by a paper transport roll 45, a transport guide (not illustrated), and the like.

The fixing unit 5 is disposed above the second transfer position of the intermediate transfer unit 3. The fixing unit 5 is configured such that devices such as a rotating body for heating 51 and a rotating body for pressurizing 52 are disposed in in the internal space of a housing 50. The sheet of paper 9 delivered after fixation in the fixing unit 5 is transported to the paper output containing unit 12 through an exit path constituted by a paper transport roll 47, a transport guide (not illustrated), and the like.

Second Transfer Roll

The second transfer roll 351 is configured as an example of a roll 6 according to the present disclosure.

As illustrated in FIGS. 3 through 5 and other drawings, the second transfer roll 351 includes a shaft 61, an elastic layer 62 and a surface layer 63 that are provided on the shaft 61, and an annular member 64 that is an example of an annular unit that is attached to both ends 61*a* and 61*b* of the shaft 61 that protrude from end surfaces 62*e* of the elastic layer 62 in a shaft direction D while being in contact with the end surfaces 62*e* of the elastic layer 62.

Figure 4A:
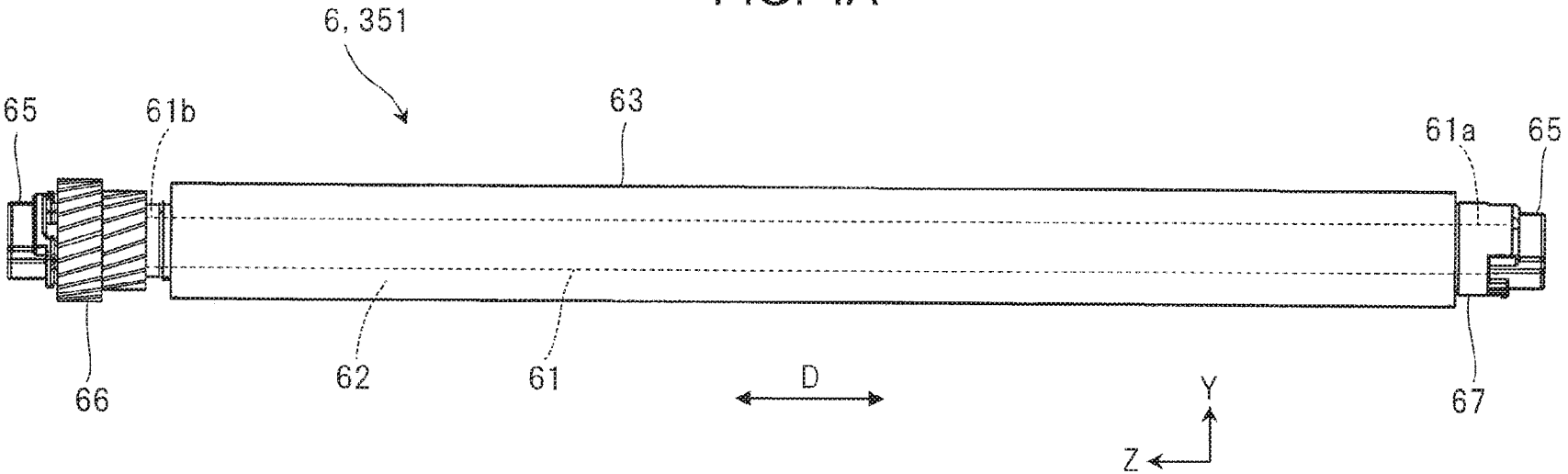
FIG. 4A is a schematic view illustrating a whole second transfer roll to which a roll according to the first exemplary embodiment is applied.
Figure 4B:
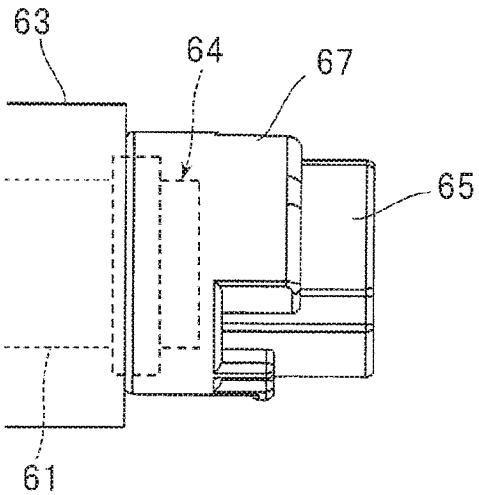
FIG. 4B is an enlarged schematic view illustrating an end of the roll of FIG. 4A.

In FIGS. 4A and 4B, a non-electrically-conductive holder 65 used to attach the whole second transfer roll 351 to an attachment part such as a support frame (not illustrated) while holding the ends 61*a* and 61*b* of the shaft 61 is illustrated. Furthermore, a two-step gear 66 that is constituted by a gear that receives rotational power transmitted to the second transfer roll 351 from a rotary drive device (not illustrated) and a relay gear that relays and transmits the rotational power to rotary components other than the second transfer roll 351 and a non-electrically-conductive cover 67 that that covers a gap between the holder 65 and the annular member (64) that will be described later are illustrated.

In each of the two holders 65, a shaft bearing that rotatably supports the end 61*a* or 61*b* of the shaft 61 is disposed. In the holder 65 on a side where the cover 67 is disposed, a power feeding member (not illustrated) that supplies a voltage for second transfer supplied from the power feeding device 15 while being in contact with the shaft 61 is disposed. The power feeding member makes contact with and is connected to a member for transmitting power from the power feeding device 15 when the second transfer roll 351 is attached.

The shaft 61 is a member having an almost columnar shape the whole of which has required diameter and length and is made of a material, such as stainless steel (SUS), having electrical conductivity.

Figure 6A:
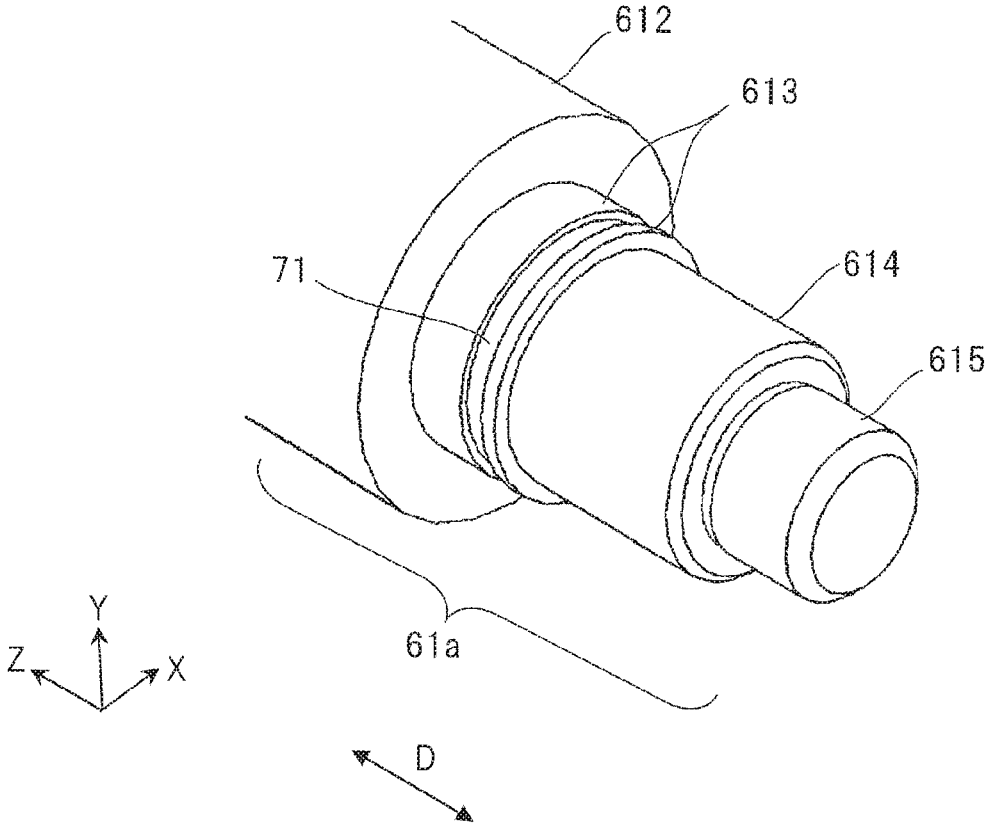
FIG. 6A is a perspective view illustrating an end of the shaft in the second transfer roll of FIGS. 5A and 5B.

As illustrated in FIG. 6A and other drawings, the shaft 61 according to the first exemplary embodiment is configured such that parts of the ends 61*a* and 61*b* to which the annular member 64 is attached are stepped parts each constituted by a large-diameter part 612 and a small-diameter part 613 that have different (large and small) external diameters. The large-diameter part 612 has the same diameter as a part where the elastic layer 62 is provided. The small-diameter part 613 is a part that has a smaller external diameter than the large-diameter part 612. In FIG. 6A, the elastic layer 62 and the surface layer 63 are omitted.

Figure 5A:
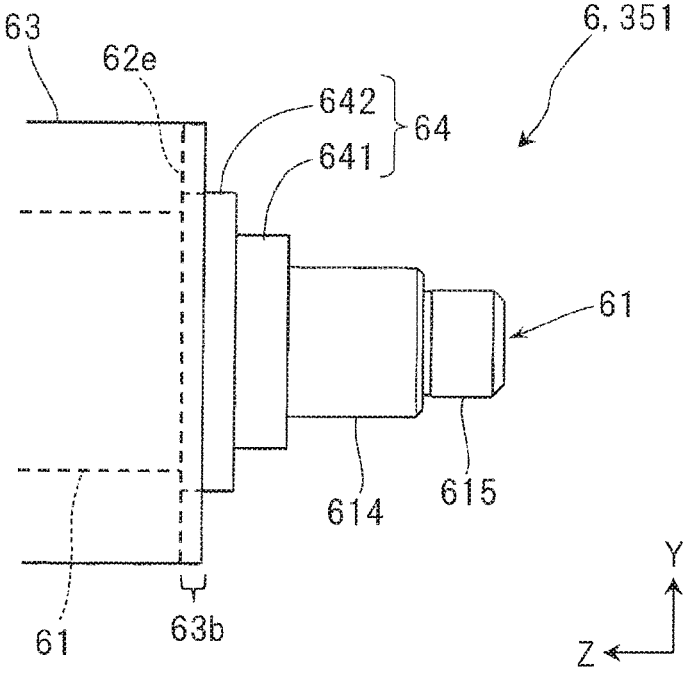
FIG. 5A is a schematic view illustrating a state where a holder and the like have been detached from one end of the second transfer roll of FIGS. 4A and 4B.
Figure 5B:
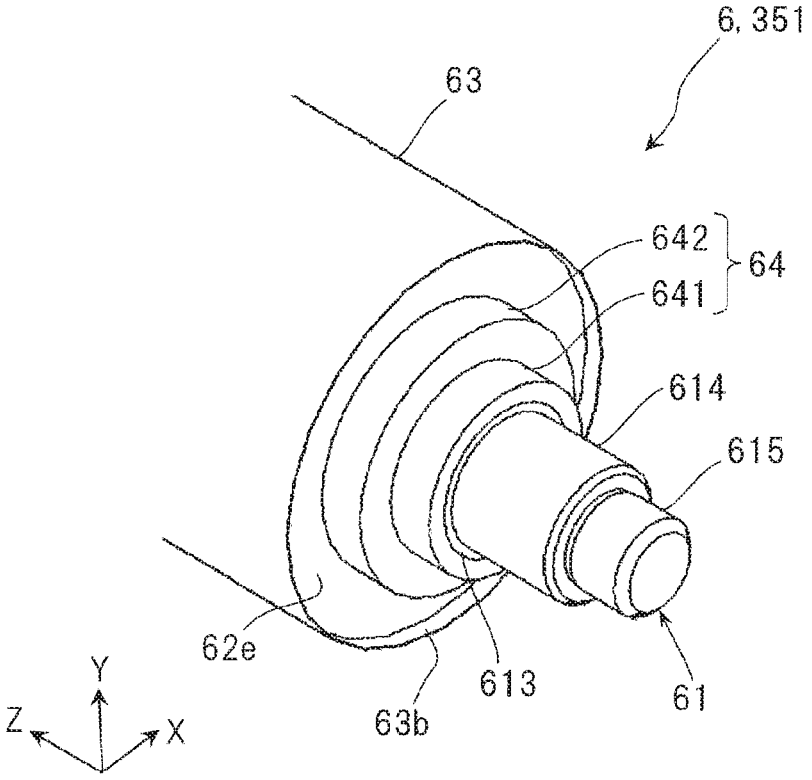
FIG. 5B is a perspective view illustrating the end of the roll of FIG. 5A.

As illustrated in FIGS. 5A, 5B, and 6A and other drawings, the shaft 61 further has, on an outer side of the small-diameter part 613, a second small-diameter part 614 that has a smaller external diameter than the small-diameter part 613 and a third small-diameter part 615 that has a smaller external diameter than the second small-diameter part 614. The second small-diameter part 614 and the third small-diameter part 615 are used for attachment of the holder 65 and attachment of the shaft bearing.

To the shaft 61, a voltage for second transfer of 5 kV to 7 kV is supplied through the power feeding member (not illustrated) provided in the holder 65 when second transfer is performed.

The elastic layer 62 is a layer that has a required thickness and is elastically deformable and is made of a material such as an electrically-conductive foam material (electrically-conductive foam ECO/NBR).

The elastic layer 62 according to the first exemplary embodiment is provided so that small portions of both ends of the large-diameter part 612 of the shaft 61 are left uncovered. Furthermore, the elastic layer 62 is configured so that a volume resistivity thereof is, for example, within a range of $10^6$ Ω·cm to $10^9$ Ω·cm.

The surface layer 63 is a surface layer for giving a required function such as release properties.

The surface layer 63 according to the first exemplary embodiment is configured as a release layer, made of a material such as polyimide, and covers an outer circumferential surface of the elastic layer 62. The surface layer 63 is configured so that a volume resistivity thereof is, for example, within a range of $10^8$ Ω·cm to $10^{12}$ Ω·cm.

As illustrated in FIGS. 5A and 5B and other drawings, the surface layer 63 projects from the ends 61*a* and 61*b* of the elastic layer 62 by a required length. In FIGS. 5A and 5B and other drawings, a projecting part 63*b* of the surface layer 63 is illustrated.

The annular member 64 is a non-electrically-conductive member (volume resistivity: $10^{15}$ Ω·cm or more) attached to the ends 61*a* and 61*b* of the shaft 61 that protrude from the end surfaces 62*e* of the elastic layer 62 while being in contact with the end surfaces 62*e* of the elastic layer 62 and is called a collar. The annular member 64 is formed to a required shape by using a material such as a polyacetal (POM) molding material (M90-44).

Figure 6B:
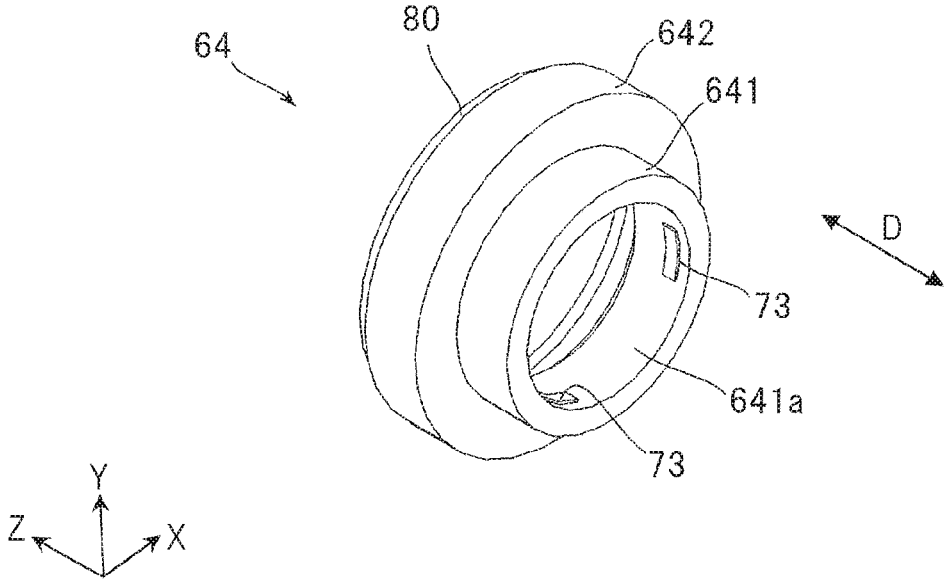
FIG. 6B is a perspective view illustrating an annular member in the second transfer roll of FIGS. 5A and 5B.
Figure 7A:
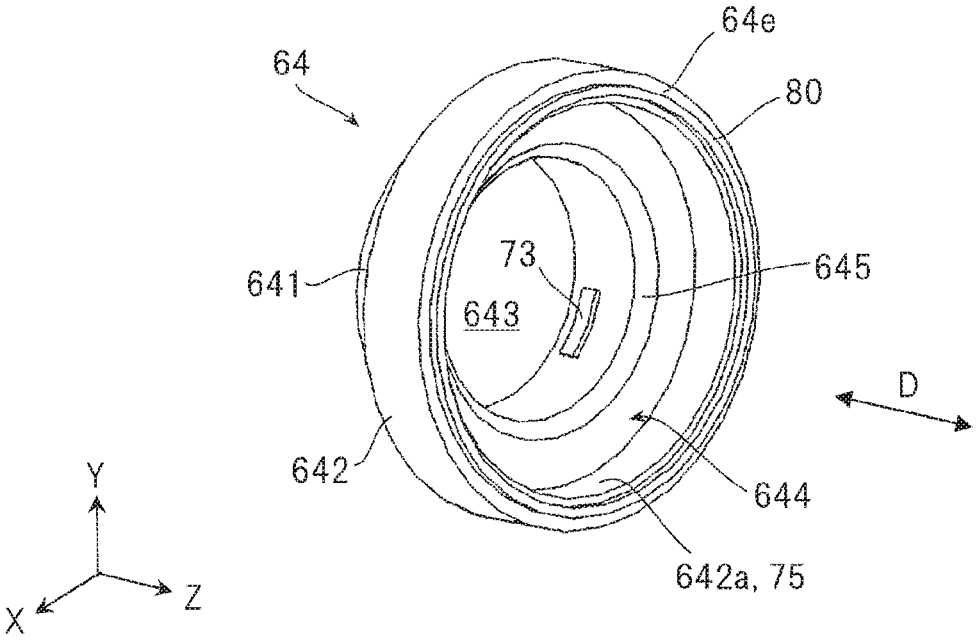
FIGS. 7A and 7B are schematic views illustrating states obtained when the annular member of FIG. 6B is viewed from different directions.
Figure 7B:
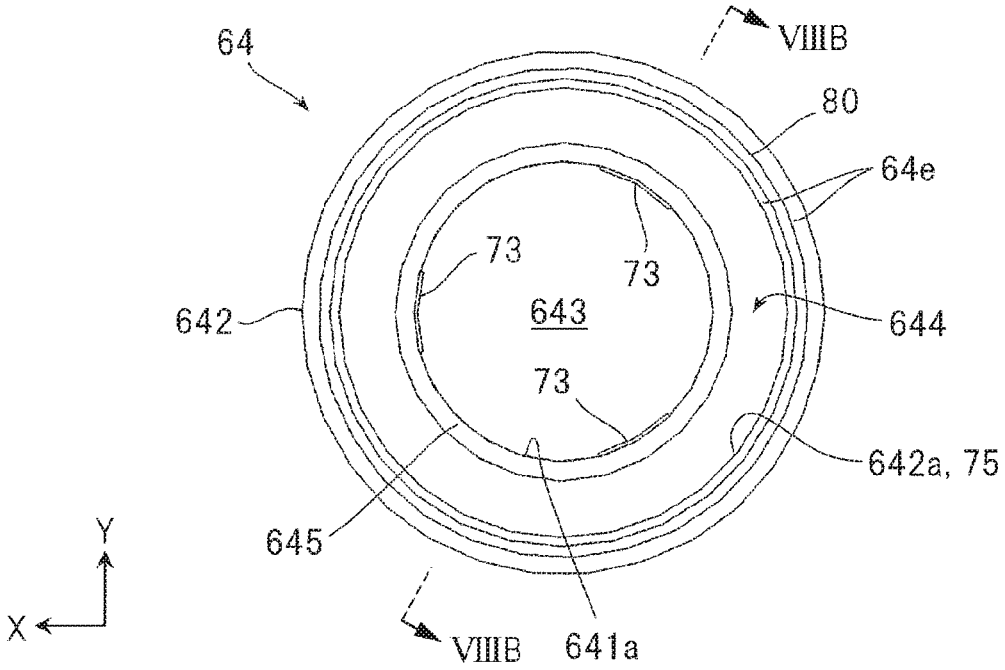

As illustrated in FIGS. 5B and 6B, the annular member 64 according to the first exemplary embodiment is configured as a two-step member having a small-diameter part 641 and a large-diameter part 642 that are fitted to and attached to the small-diameter part 613 and the large-diameter part 612 of the stepped part of the shaft 61, respectively. An attachment hole (a hollow space) 643 having a columnar shape of a small diameter into which the small-diameter part 613 of the shaft 61 can be fitted is formed inside the small-diameter part 641. An attachment hole (recess) 644 having a large diameter and recessed toward the small-diameter part 641 is formed inside the large-diameter part 642 so that the large-diameter part 612 of the shaft 61 can be fitted into the attachment hole 644. A boundary part between the attachment hole 643 having the small diameter and the attachment hole 644 having the large diameter is a tapered surface 645 that is a slope expending from the attachment hole 643 having the small diameter toward the attachment hole 644 having the large diameter as illustrated in FIGS. 7A and 7B.

Figure 13A:
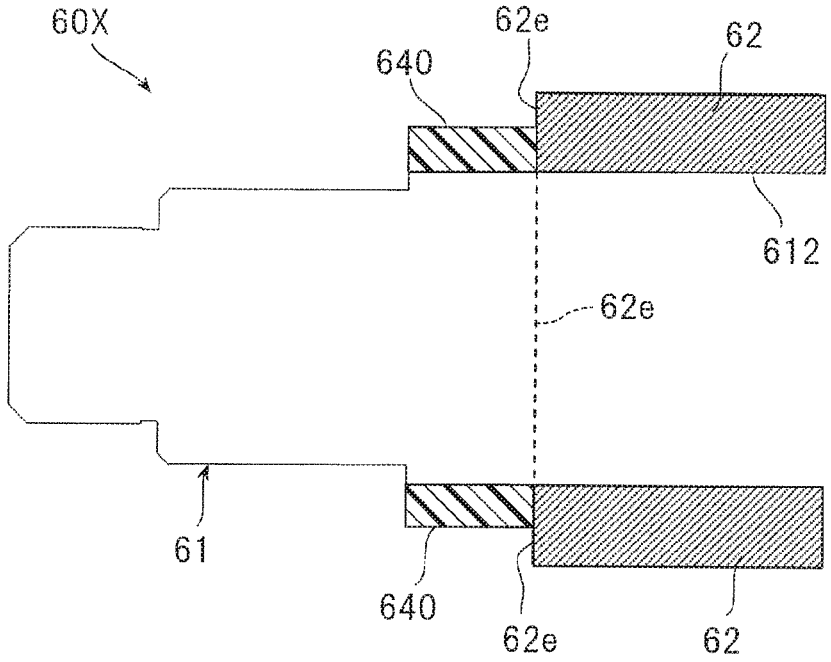
FIGS. 13A and 13B are schematic cross-sectional views illustrating a configuration of an annular member in a second transfer roll according to a first comparative example and a state during occurrence of discharge.

According to studies of the inventor of the present disclosure, it has been confirmed that the following troubles occur in a case where a roll 60X according to a first comparative example in which an annular member 640 for comparison that is different from the annular member 64 only in that the annular member 640 does not have a stepped shape is attached to an end of the shaft 61 while being in contact with the end surface 62*e* of the elastic layer 62 instead of the annular member 64 is applied as the second transfer roll 351 as illustrated in FIG. 13A. The annular member 640 is firmly fixed to one end of the shaft 61 by a method such as press fitting.

That is, in a case where the roll 60X according to the first comparative example is used as the second transfer roll 351 to which a voltage for second transfer of approximately 5 kV to 7 kV is supplied, discharge sometimes occurs after elapse of a certain period (e.g., 100 hours or longer). It is estimated that this discharge occurs from the shaft 61 of the roll 60X toward the intermediate transfer belt 31.

Figure 13B:
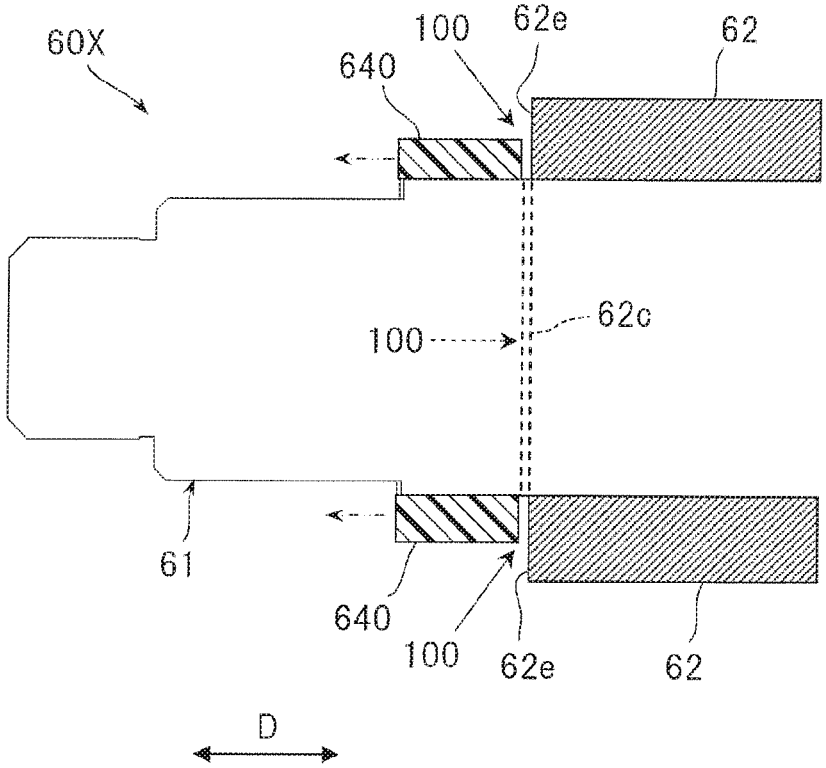

As a result of examination of the roll 60X that causes the discharge, it has been confirmed that a small gap 100 reaching the shaft 61 is present between the annular member 640 and the end surface 62*e* of the elastic layer 62 as illustrated in FIG. 13B. The gap 100 is considered to have occurred because the annular member 640 is slightly deviated in the shaft direction D from the end surface 62*e* of the elastic layer 62 as illustrated in FIG. 13B. This gap 100 occurs throughout an entire range in a circumferential direction of the annular member 640.

In view of this, in the roll 6 that serves as the second transfer roll 351, a protruding part 80 that cuts into the end surface 62*e* of the elastic layer 62 is provided on an end surface 64*e* of the annular member 64 that makes contact with the end surface 62*e* of the elastic layer 62 as illustrated in FIGS. 7A, 7B, 8B, 9A, and 9B and other drawings.

Figure 8A:
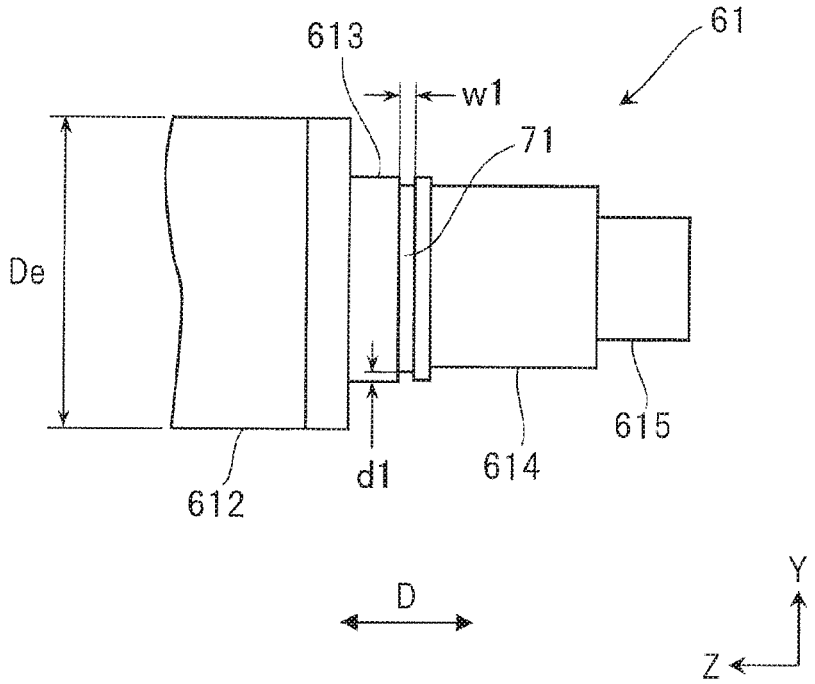
FIG. 8A is a schematic view illustrating an end of the shaft in the second transfer roll of FIGS. 5A and 5B.
Figure 8B:
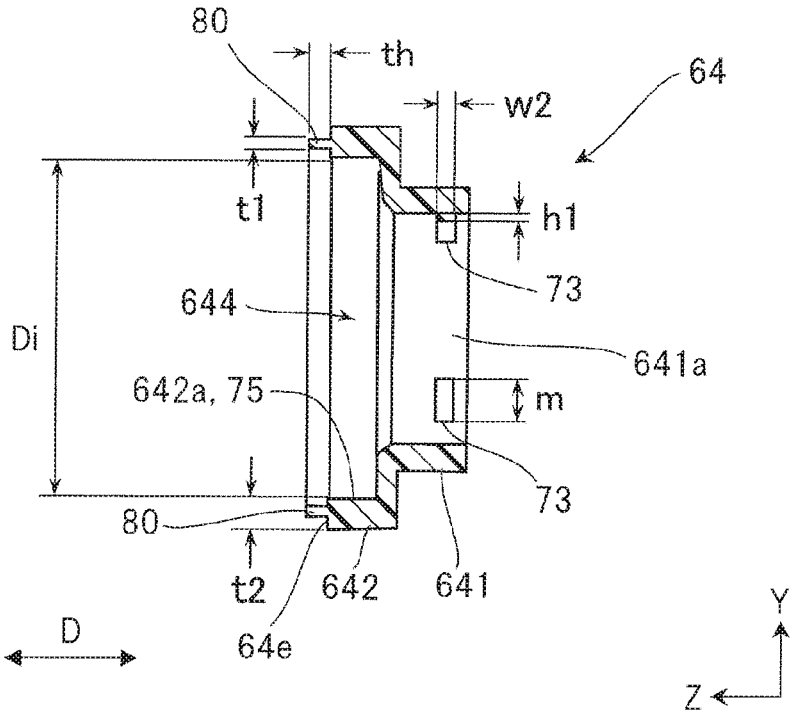
FIG. 8B is a schematic cross-sectional view taken along line VIIIB-VIIIB of the annular member of FIG. 7B.

As illustrated in FIG. 8B, the protruding part 80 has a thickness t1 (<t2) smaller than a thickness t2 of the end surface 64*e* of the annular member 64.

The thickness t1 of the protruding part 80 is desirably smaller than ½ of the thickness t2 of the end surface 64*e* of the annular member 64, for example, from a perspective of a reduction of excessive deformation of the elastic layer 62 caused by the protruding part 80 cutting into the elastic layer 62. Meanwhile, the thickness t1 of the protruding part 80 is desirably larger than ¼ of the thickness t2 of the end surface 64*e* of the annular member 64, for example, from a perspective of avoidance of induction of troubles such as breakage or cracking of the elastic layer 62 caused by the protruding part 80 cutting into the elastic layer 62.

In the first exemplary embodiment, for example, in a case where the thickness t2 of the end surface 64*e* of the annular member 64 is 1.3 mm, a protruding part having a thickness t1 of 0.3 mm is provided as the protruding part 80.

Figure 12A:
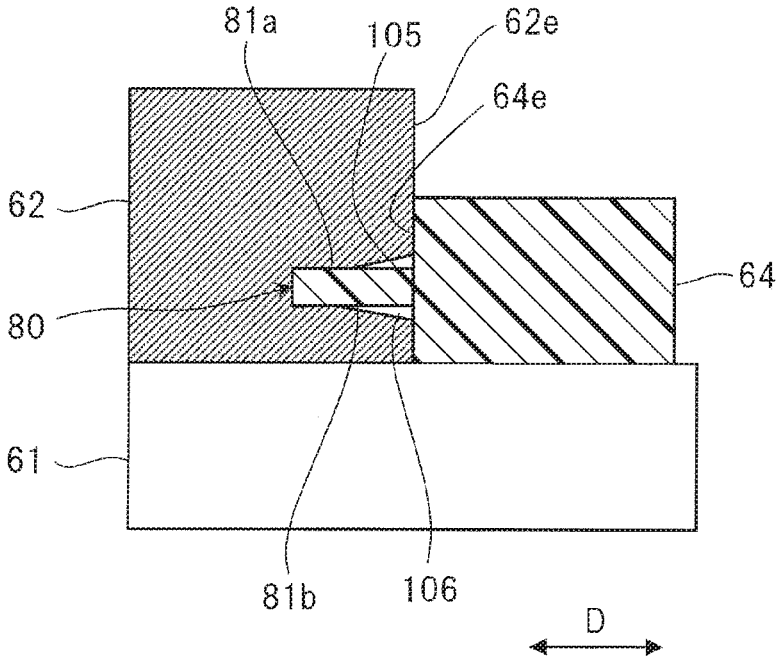
FIG. 12A is a cross-sectional conceptual view illustrating a state of a part where a protruding part of the annular member according to the first exemplary embodiment cuts into an elastic layer in an exaggerated manner.

As illustrated in FIG. 8B, the protruding part 80 according to the first exemplary embodiment is a part that has a rectangular cross section and protrudes in almost parallel with the shaft direction D from the end surface 64*e* of the large-diameter part 642 since a part of the annular member 64 that makes contact with the end surface 62*e* of the elastic layer 62 is the large-diameter part 642. More specifically, as illustrated in FIG. 12A, the protruding part 80 has a shape having an outer parallel surface (strictly an outer circumferential surface of the cylindrical part) 81*a* and an inner parallel surface (strictly an inner circumferential surface of a cylindrical part) 81*b* that are parallel with the shaft direction D in a direction in which the protruding part 80 protrudes from the end surface 64*e* of the annular member 64.

As illustrated in FIGS. 7A and 7B, since the end surface 64*e* of the large-diameter part 642 of the annular member 64 has an annular shape, the protruding part 80 has a shape continuous in an annular manner in accordance with the annular shape of the end surface 64*e*.

Figure 9A:
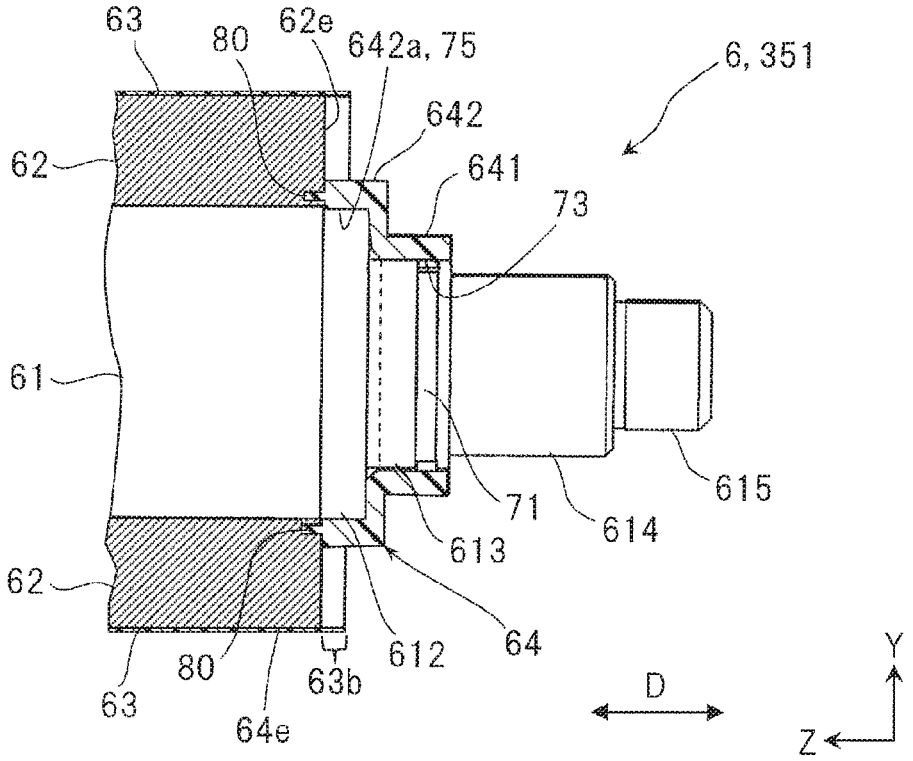
FIG. 9A is a partial cross-sectional view illustrating a state where an annular member is attached in one end of the second transfer roll of FIGS. 5A and 5B.
Figure 9B:
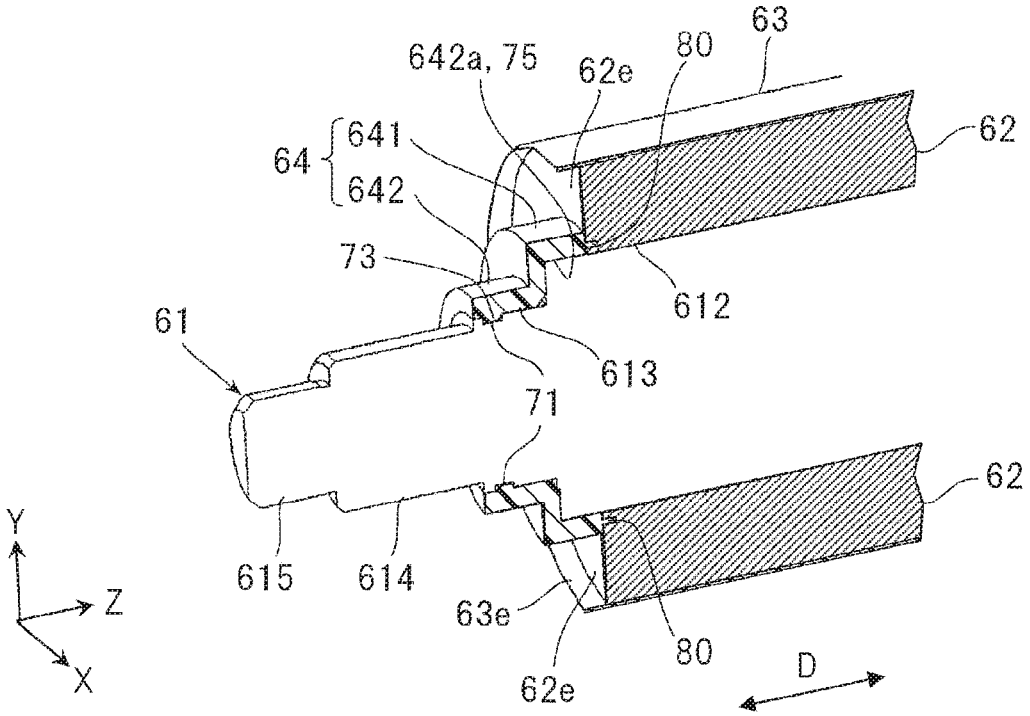
FIG. 9B is a vertical cross-sectional view illustrating one end of the second transfer roll of FIGS. 5A and 5B.

Furthermore, as illustrated in FIGS. 9A and 9B, the protruding part 80 is provided so as not to make contact with the shaft 61 in a case where the annular member 64 is attached. In the first exemplary embodiment, the protruding part 80 is provided at an almost middle position in a thickness direction of the end surface 64*e* of the large-diameter part 642 as illustrated in FIGS. 7A, 7B, and 8B and other drawings.

In the roll 6 that serves as the second transfer roll 351 according to the first exemplary embodiment, a fixing part 71 that fixes an attachment position of the annular member 64 in the shaft direction D is provided on parts of the ends 61*a* and 61*b* of the shaft 61 where the annular member 64 is attached, and a fixed part 73 fixed by the fixing part 71 of the shaft 61 is provided on a part of an inner circumferential surface (614*a*) of the annular member 64 in the shaft direction D, as illustrated in FIGS. 6A, 6B, 7A, 7B, 8A, and 8B and other drawings.

As illustrated in FIG. 6A and other drawings, since the part of the shaft 61 where the annular member 64 is attached is a stepped part constituted by the large-diameter part 612 and the small-diameter part 613, the fixing part 71 is provided on the small-diameter part 613 of the stepped part.

As illustrated in FIGS. 6A and 8A and other drawings, the fixing part 71 is a groove (an example of a recess) continuous throughout an entire range in a circumferential direction of the small-diameter part 613 of the shaft 61. The circumferential direction is a direction that is almost orthogonal to (crosses at an angle of 90°±1°) the shaft direction D. The groove of the fixing part 71 is an annular groove that has an almost rectangular cross section and required width w1 and depth d1 and is continuous throughout the entire range in the circumferential direction of the small-diameter part 613.

Meanwhile, as illustrated in FIG. 6B and other drawings, the fixed part 73 is provided on an inner circumferential surface 641*a* of the attachment hole 643 having the small diameter in the small-diameter part 641 since the annular member 64 has a two-step shape having the small-diameter part 641 and the large-diameter part 642 and a part attached to the small-diameter part 613 of the shaft 61 on which the fixing part 71 is provided is the small-diameter part 641.

This fixed part 73 has a shape that is fitted into the groove of the fixing part 71 of the shaft 61 and is not displaced at least in the shaft direction D. Furthermore, the fixed part 73 is located so that the end surface 64*e* of the large-diameter part 642 of the annular member 64 is in contact with the end surface 62*e* of the elastic layer 62 in a case where the fixed part 73 is fitted into the groove of the fixing part 71 provided on the shaft 61.

As illustrated in FIGS. 6B, 7A, 7B, and 8B and other drawings, plural (three in this example) fixed parts 73 are provided at intervals in the circumferential direction of the inner circumferential surface 641*a* of the small-diameter part 641 of the annular member 64. Furthermore, each of the fixed parts 73 is a plate-shaped protrusion (an example of a raised part) that has required width w2 and height h1, is raised from the inner circumferential surface 641*a* of the small-diameter part 641, and extends so as to be curved in an arc shape having a required length m in the circumferential direction.

In this case, the width w2 of the fixed part 73 is very slightly smaller than the width w1 of the groove of the fixing part 71. The height h1 of the fixed part 73 is slightly lower than the depth d1 of the groove of the fixing part 71 and is, for example, approximately 0.01 mm to 0.06 mm. Furthermore, the length m of each fixed part 73 is shorter than ⅓ (e.g., approximately 1/18) of the circumferential length of the inner circumferential surface 641*a* since three fixed parts 73 are provided at intervals in the circumferential direction of the inner circumferential surface 641*a* of the small-diameter part 641.

Furthermore, in the roll 6 that serves as the second transfer roll 351 in the first exemplary embodiment, a part of the inner circumferential surface of the annular member 64 except for a part where the fixed parts 73 are provided is configured as a press-fitted part 75 that is press-fitted to the ends 61*a* and 61*b* of the shaft 61.

Since the fixed parts 73 are provided in a part of the small-diameter part 641 of the inner circumferential surface 641*a* along the circumferential direction, a part of the inner circumferential surface of the annular member 64 according to the first exemplary embodiment except for a part where the fixed parts 73 are provided is the inner circumferential surface 642*a* of the large-diameter part 642 that is not the inner circumferential surface 641*a* of the small-diameter part 641.

The press fitting means attaching the press-fitted part 75 of the annular member 64 to an attachment part of the shaft 61 by pressing the press-fitted part 75 onto the attachment part by application of pressure. Accordingly, as illustrated in FIGS. 8A and 8B, for example, the press-fitted part 75 is configured such that an inner diameter Di of the press-fitted large-diameter part 642 of the annular member 64 is the same as or very slightly smaller than an external diameter De of the large-diameter part 612 of the shaft 61 to which the press-fitted part 75 is attached, and the press-fitted part 75 is made of a material that can be deformed so that a diameter thereof temporarily expands without breaking the large-diameter part 642 and the like when certain force or larger force is applied to the annular member 64.

The roll 6 that serves as the second transfer roll 351 is, for example, assembled in the following order.

First, the annular member 64 is attached to the large-diameter part 612 and the small-diameter part 613 of the shaft 61 in the second transfer roll 351. This second transfer roll 351 is a roll configured such that the elastic layer 62 and the surface layer 63 are provided in this order within a predetermined range of the large-diameter part 612 of the shaft 61.

The small-diameter part 641 of the annular member 64 is attached to the small-diameter part 613 of the shaft 61 at an almost same time as the large-diameter part 642 of the annular member 64 is press-fitted to the large-diameter part 612 of the shaft 61.

In particular, in a case where the small-diameter part 641 of the annular member 64 is attached to the small-diameter part 613 of the shaft, the fixed parts 73 that are three protrusions on the inner circumferential surface 641*a* of the small-diameter part 641 of the annular member 64 are fitted into the continuous groove-shaped fixing part 71 provided on the small-diameter part 613 of the shaft 61 as illustrated in FIGS. 9A and 9B.

This prevents the three fixed parts 73 provided on the annular member 64 from moving in the shaft direction D since the fixed parts 73 make contact with left and right groove side wall surfaces of the groove-shaped fixing part 71 of the shaft 61 in the shaft direction D. As a result, the annular member 64 is fixed to the shaft 61 without being displaced in the shaft direction D, thereby keeping a state where the annular member 64 is in contact with the end surface 62*e* of the elastic layer 62.

When the large-diameter part 642 of the annular member 64 is attached to the large-diameter part 612 of the shaft 61, the end surface 64*e* of the large-diameter part 642 is in contact with the end surface 62*e* of the elastic layer 62 in a state where the protruding part 80 cuts into the end surface 62*e* of the elastic layer 62 as illustrated in FIGS. 9A and 9B.

As illustrated in FIG. 12A, the protruding part 80 cuts into the end surface 62*e* of the elastic layer 62 by elastically deforming a part of the end surface 62*e* of the elastic layer 62 inward along the shaft direction D.

Since the protruding part 80 has the thickness t1 smaller than the thickness t2 of the end surface 64*e* of the annular member 64, the protruding part 80 easily cuts into the part of the end surface 62*e* of the elastic layer 62 without elastically deforming the part of the end surface 62*e* of the elastic layer 62 more than necessary. The effect concerning the state where the protruding part 80 cuts into the part of the end surface 62*e* of the elastic layer 62 is more remarkable in a case where the thickness t1 of the protruding part 80 is smaller than ½ of the thickness t2 of the end surface 64*e* of the annular member 64.

As a result, a gap is harder to occur between the end surface 64*e* of the annular member 64 and the end surface 62*e* of the elastic layer 62 since not only the end surface 64*e* of the large-diameter part 642 of the annular member 64 is in contact with the end surface 62*e* of the elastic layer 62, but also a state where the end surface 64*e* of the annular member 64 is press-fitted to the end surface 62*e* of the elastic layer 62 is kept as compared with a case where the protruding part 80 is not provided on the annular member 64.

Furthermore, when the large-diameter part 642 of the annular member 64 is attached to the large-diameter part 612 of the shaft 61, the large-diameter part 642 is attached in a press-fitted state since the inner circumferential surface 642*a* of the large-diameter part 642 is configured as the press-fitted part 75.

As a result, the annular member 64 is harder to move in the shaft direction D of the shaft 61. This keeps a state where the annular member 64 is firmly attached in the shaft direction D in cooperation with the effect of preventing movement in the shaft direction D by engagement of the fixing part 71 and the fixed part 73. Furthermore, the annular member 64 is harder to move in the circumferential direction of the shaft 61, and therefore a state where the annular member 64 is firmly attached is kept.

Next, as illustrated in FIGS. 4A and 4B, in the second transfer roll 351, the holder 65 having a shaft bearing is attached to one end 61*a* of the shaft 61, and then the cover 67 is attached so as to cover an almost whole part of the holder 65 from an outer side. Furthermore, in the second transfer roll 351, the two-step gear 66 is attached to the other end 61*b*, and then the holder 65 is attached so as to be inserted into an inner side of the outer gear of the two-step gear 66. This completes the second transfer roll 351 as the roll 6 having the appearance illustrated in FIGS. 4A and 4B.

Furthermore, the completed second transfer roll 351 is attached to the attachment part in the second transfer device 35 of the image forming apparatus 1. When the second transfer roll 351 is rightly set at the second transfer position in the image forming apparatus 1, the shaft 61 becomes electrically conductive with the power feeding device 15.

In a case where the roll 6 that serves as the second transfer roll 351 is used for a certain period (e.g., 100 hours or longer) in a second transfer step by supplying a voltage for second transfer of approximately 5 kV to 7 kV to the roll 6 from the power feeding device 15, it has been confirmed that occurrence of discharge through a gap between the annular member 64 and the elastic layer 62 is suppressed as compared with a case where the protruding part 80 that cuts into the end surface 62*e* of the elastic layer 62 is not provided on the end surface 64*e* of the annular member 64 that makes contact with the end surface 62*e* of the elastic layer 62.

Furthermore, when this second transfer roll 351 is inspected, presence of a gap is not confirmed between the annular member 64 and the end surface 62*e* of the elastic layer 62 as illustrated in FIG. 9A. In the second transfer roll 351, both ends of the surface layer 63 have the projecting part 63*b* projecting to a side outside the end surface 62*e* of the elastic layer 62. With this configuration, discharge caused due to a gap between the annular member 64 and the end surface 62*e* of the elastic layer 62 is harder to occur.

In this second transfer roll 351, the protruding part 80 having a shape continuous in an annular manner is provided on the end surface 64*e* of the large-diameter part 642 of the annular member 64. Accordingly, the protruding part 80 cuts into the annular end surface 62*e* of the elastic layer 62 continuously without interruption, and therefore a gap is further harder to occur between the annular member 64 and the end surface 62*e* of the elastic layer 62. This also makes the discharge harder to occur.

Furthermore, in this second transfer roll 351, the protruding part 80 is provided so as not to make contact with the shaft 61 when the annular member 64 is attached. Therefore, the elastic layer 62 is hard to peel off from a circumferential surface of the shaft 61 (the large-diameter part 612) even in a case where the elastic layer 62 is elastically deformed when the protruding part 80 cuts into the elastic layer 62, and there is no risk of occurrence of a new gap between the end surface 64*e* of the large-diameter part 642 of the annular member 64 and the outer circumferential surface of the shaft 61. This also suppresses occurrence of the discharge.

Strictly speaking, in a place where the protruding part 80 of the annular member 64 cuts into the end surface 62*e* of the elastic layer 62, a slight outer gap 105 occurs between the protruding part 80 and the elastic layer 62 on a side where the outer parallel surface 81*a* is present due to elastic deformation and an inner gap 106 similarly occurs between the protruding part 80 and the elastic layer 62 on a side where the inner parallel surface 81*b* is present due to elastic deformation as illustrated in FIG. 12A in an exaggerated manner.

However, even in a case where the slight gaps 105 and 106 occur between the protruding part 80 and the elastic layer 62, an electric path leading to an outside of the roll is hard to be formed due to the two parallel surfaces 81*a* and 81*b* that are parallel with the shaft 61 on a side away from the shaft 61 and almost orthogonal to the end surface 62*e* of the elastic layer 62, and therefore discharge that flows between the outside of the roll and the shaft 61 while passing the outer gap 105 and then the inner gap 106 is hard to occur.

In the image forming apparatus 1 in which the second transfer roll 351 that the roll 6 is applied to the second transfer device 35, occurrence of discharge through a gap that occurs between the annular member 64 and the elastic layer 62 due to a factor such as passage of time in the second transfer roll 351 is suppressed, and occurrence of a secondary failure caused by the discharge is also suppressed. The secondary failure is a trouble such as ignition of a foaming material such as the elastic layer 62 in the second transfer roll 351.

Second Exemplary Embodiment

Figure 10:
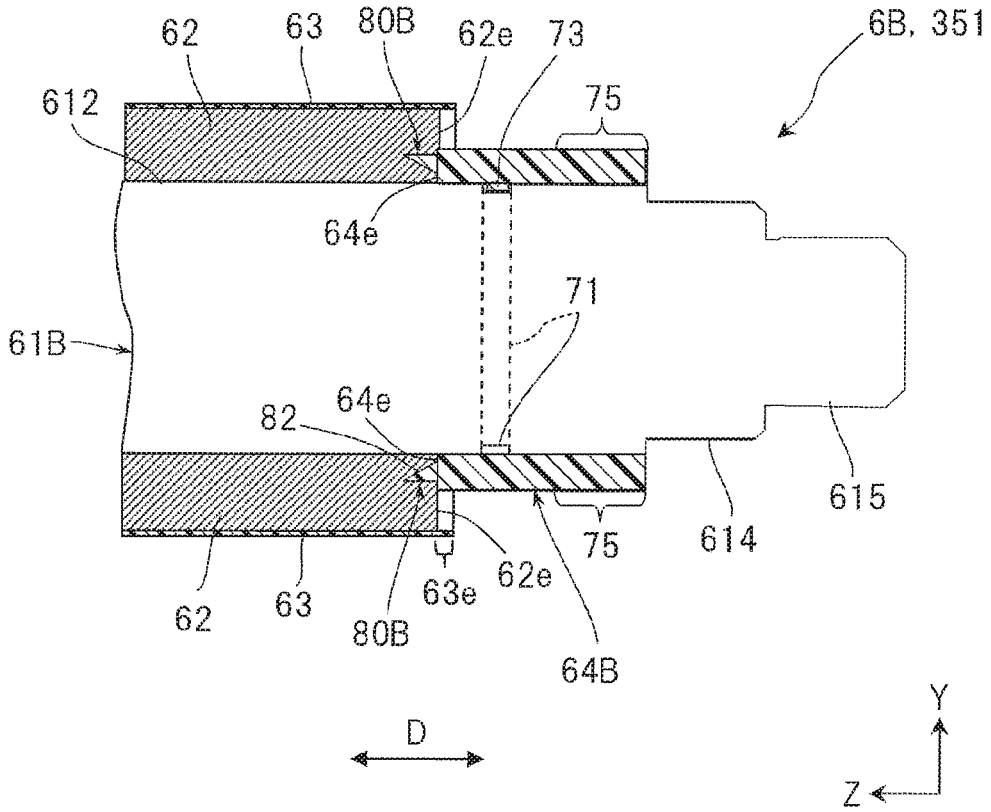
FIG. 10 is a cross-sectional view illustrating a representative one end of a second transfer roll according to a second exemplary embodiment.

FIG. 10 illustrates a part of a roll 6B that serves as a second transfer roll 351 according to the second exemplary embodiment.

Figure 11A:
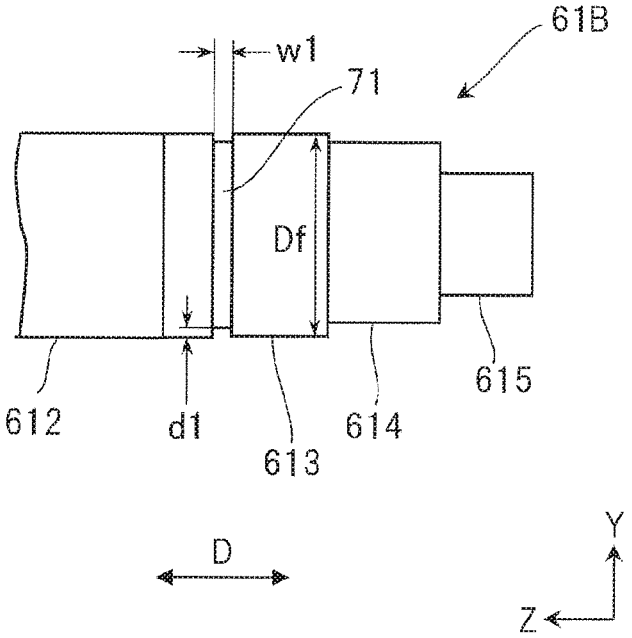
FIG. 11A is a schematic view illustrating one end of a shaft in the second transfer roll of FIG. 10.
Figure 11B:
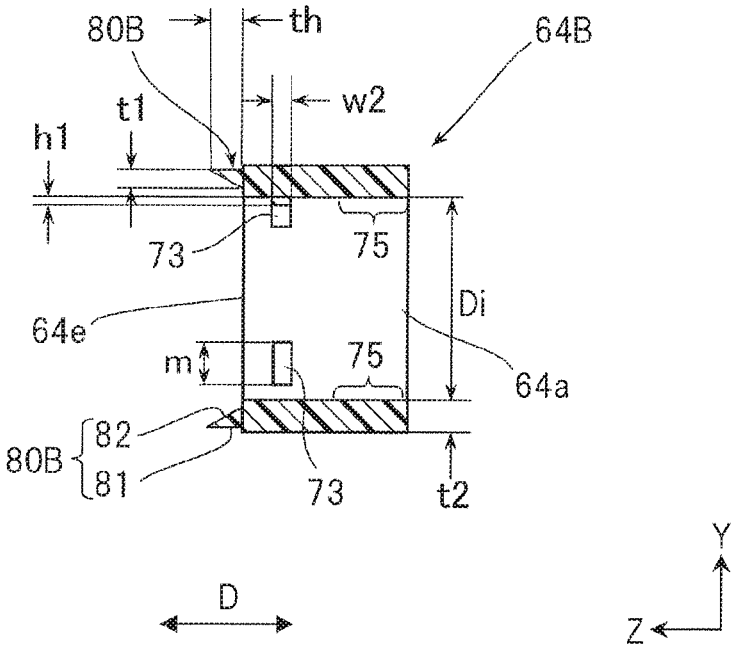
FIG. 11B is a schematic cross-sectional view illustrating an annular member in the second transfer roll of FIG. 10.

As illustrated in FIGS. 10, 11A, and 11B, the roll 6B according to the second exemplary embodiment has a configuration identical to the roll 6 according to the first exemplary embodiment except for that a shaft 61B configured such that a large-diameter part 612 provided with a groove-shaped fixing part 71 is elongated outward is applied, a cylindrical annular member 64B that does not have a two-step shape is applied, a protruding part 80B having a different shape is provided on an end surface 64*e* of the annular member 64B that makes contact with an elastic layer 62 and a fixed part 73 is provided on part on a side close to the end surface 64*e*, and a part on a side far from the end surface 64*e* is configured as a press-fitted part 75.

The protruding part 80B is an annular protruding part that has an almost similar configuration (FIGS. 7A, 7B, and 8B) to the protruding part 80 according to the first exemplary embodiment except for that the protruding part 80B is provided on the annular end surface 64*e* of the cylindrical annular member 64B and has a different shape.

As illustrated in FIG. 11B, the protruding part 80B has a parallel surface (strictly a circumferential surface of a cylindrical part) 81 extending in parallel with a shaft direction D in a direction in which the protruding part 80B protrude from the end surface 64*e* of the annular member 64B and an inclined surface (strictly a circumferential surface of a circular truncated cone) 82 that faces the large-diameter part 612 of the shaft 61B and is inclined so as to gradually separate away from the large-diameter part 612 of the shaft 61B in the protruding direction and has a cross section that has a tapered shape similar to a right-angled triangle. The parallel surface 81 and the inclined surface 82 cross each other in the direction in which the protruding part 80B protrudes from the end surface 64*e* of the annular member 64B.

As illustrated in FIG. 11B, the protruding part 80B has a thickness t1 (a thickness of a thickest part, i.e., a thickness of a part on the end surface 64*e*) smaller than a thickness t2 of the end surface 64*e* of the annular member 64B. Furthermore, as illustrated in FIG. 10, the protruding part 80B is provided so that the inclined surface 82 does not make contact with the large-diameter part 612 of the shaft 61B.

As illustrated in FIG. 11A, the fixing part 71 provided on the large-diameter part 612 of the shaft 61B is a groove-shaped fixing part that has an almost similar configuration (FIG. 8A) to the fixing part 71 according to the first exemplary embodiment.

As illustrated in FIG. 11B, the fixed part 73 provided on the inner circumferential surface 64*a* of the annular member 64B are three fixed parts having an almost similar configuration (FIG. 8B) to the fixed parts 73 according to the first exemplary embodiment.

Furthermore, the press-fitted part 75 on the side far from the end surface 64*e* is, for example, configured so that an inner diameter Di of the inner circumferential surface 64*a* of the annular member 64B is the same as an external shape Df of a small-diameter part 613 of the shaft 61B.

The annular member 64B in this roll 6B is attached to the large-diameter part 612 of the shaft 61B from a side where an end of the end surface 64*e* that makes contact with the elastic layer 62 is present.

In particular, when the part on the side close to the end surface 64*e* of the annular member 64B is attached to the large-diameter part 612 of the shaft 61B, the three fixed parts 73 on the inner circumferential surface 64*a* of the annular member 64B are fitted into the fixing part 71 having a continuous groove shape provided on the large-diameter part 612 of the shaft 61B.

When the part on the side far from the end surface 64*e* of the annular member 64B is attached to the large-diameter part 612 of the shaft 61B, the press-fitted part 75 on the inner circumferential surface 64*a* of the annular member 64B is press-fitted.

In the second transfer roll 351 that is the roll 6B, occurrence of discharge through a gap between the annular member 64B and the elastic layer 62 is suppressed as compared with a case where the protruding part 80B that cuts into the end surface 62*e* of the elastic layer 62 is not provided on the end surface 64*e* of the annular member 64B, almost similarly to the case of the roll 6 according to the first exemplary embodiment.

Furthermore, in the roll 6B, the protruding part 80B is provided on the end surface 64*e* of the annular member 64B as a protruding part having a shape continuous in an annular manner and therefore cuts into the annular end surface 62*e* of the elastic layer 62 continuously without interruption, almost similarly to the case of the roll 6 according to the first exemplary embodiment. This also makes the discharge harder to occur.

Furthermore, in the roll 6B, the protruding part 80B is provided so as not to make contact with the shaft 61B when the annular member 64B is attached, and therefore the elastic layer 62 is hard to peel off from a circumferential surface of the shaft 61B (the large-diameter part 612) even in a case where the elastic layer 62 is elastically deformed by the protruding part 80B that cuts into the elastic layer 62, almost similarly to the case of the roll 6 according to the first exemplary embodiment. This also suppresses occurrence of the discharge.

Furthermore, in the roll 6B, the protruding part 80B provided on the annular member 64B has a tapered shape constituted by the parallel surface 81 and the inclined surface 82, and therefore the following occurs.

First, the protruding part 80B having a tapered shape easily cuts into the end surface 62*e* of the elastic layer 62 while keeping an amount of elastic deformation small.

Figure 12B:
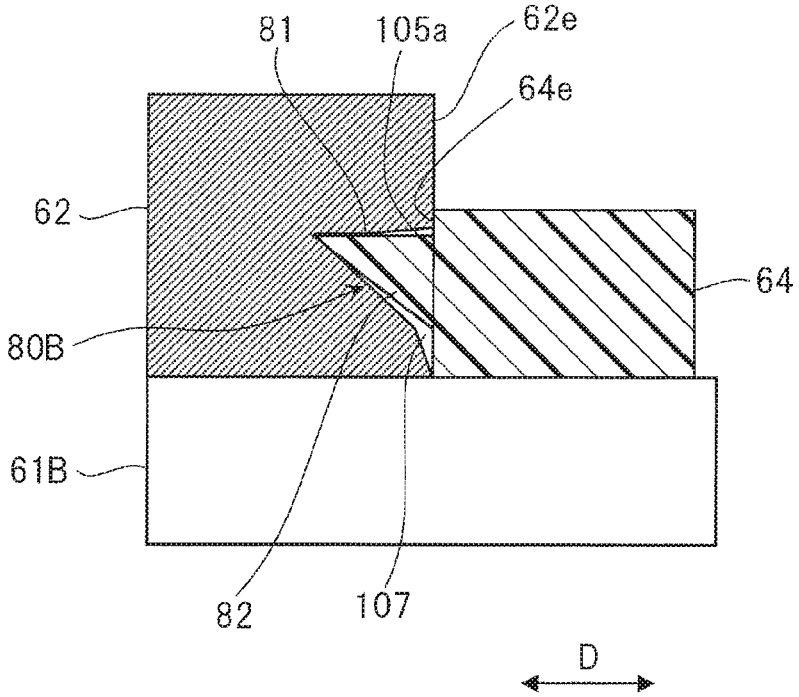
FIG. 12B is a cross-sectional conceptual view illustrating a state of a part where a protruding part of an annular member according to the second exemplary embodiment cuts into an elastic layer in an exaggerated manner.

Furthermore, strictly speaking, between the protruding part 80B and the elastic layer 62, a slight outer gap 105*a* occurs on a side where the parallel surface 81 is present due to elastic deformation and an inner gap 107 occurs on a side where the inclined surface 82 is present due to elastic deformation as illustrated in FIG. 12B in an exaggerated manner.

In this case, however, an electric path leading to an outside of the roll is hard to be formed because of the parallel surface 81 that is parallel with the shaft 61B on a side away from the shaft 61B and is almost orthogonal to the end surface 62*e* of the elastic layer 62 although the inner gap 107 is a gap that approaches the shaft 61B. As a result, discharge that flows between the outside of the roll and the shaft 61B while passing the outer gap 105*a* and then the inner gap 107 is hard to occur.

Figure 14A:
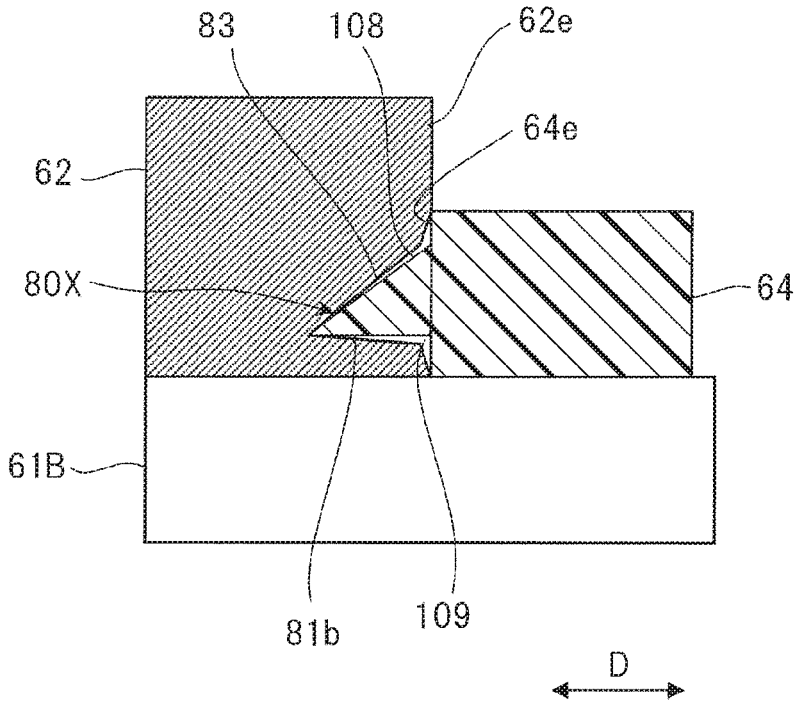
FIGS. 14A and 14B are cross-sectional conceptual views illustrating a state of a part where two kinds of protruding parts that are comparative reference examples of a protruding part of an annular member cut into an elastic layer in an exaggerated manner.

For reference, in a case where a protruding part 80X having a shape illustrated in FIG. 14A is employed, there is a risk of occurrence of discharge flowing between the protruding part 80X and the elastic layer 62.

The protruding part 80X is a protruding part having a tapered shape whose surface facing the shaft 61B is a parallel surface 81*b* and whose surface away from the shaft 61B is an inclined surface 83.

Strictly speaking, between the protruding part 80X and the elastic layer 62 into which the protruding part 80X cuts, a slight outer gap 108 that approaches the shaft 61B occurs on a side where the inclined surface 83 is present and a slight inner gap 109 occurs on a side where the parallel surface 81*b* is present as illustrated in FIG. 14A in an exaggerated manner. In this case, an electric path leading to an outside of the roll is easily formed by the outer gap 108, and therefore there is a risk of occurrence of discharge that flows between the outside of the roll and the shaft 61B while passing the outer gap 108 and then the inner gap 109.

Figure 14B:
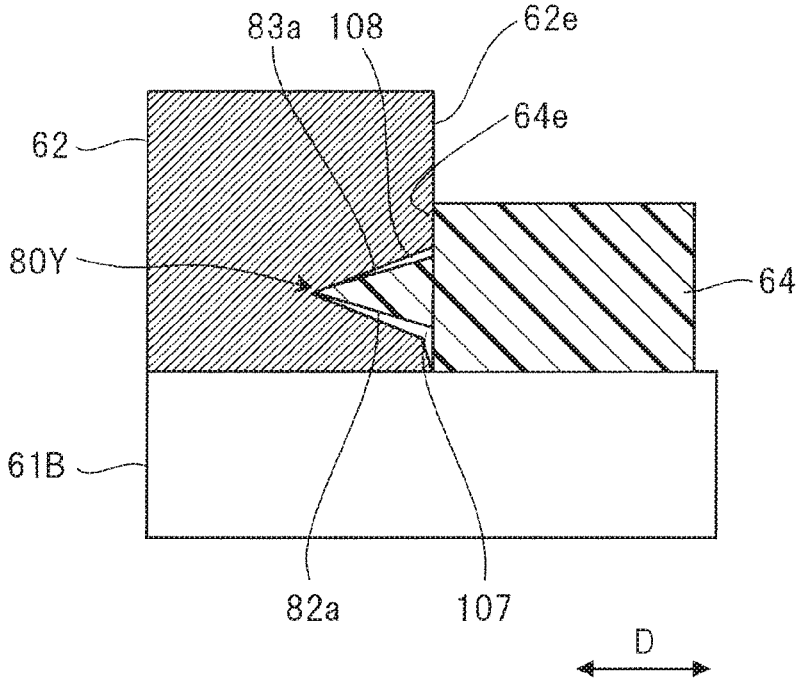

For reference, in a case where a protruding part 80Y having a shape illustrated in FIG. 14B is employed, there is a risk of occurrence of discharge between the protruding part 80Y and the elastic layer 62.

The protruding part 80Y is a protruding part having a tapered shape whose surface facing the shaft 61B is an outer inclined surface 82*a* and whose surface on a side away from the shaft 61B is an inner inclined surface 83*a*.

Strictly speaking, between the protruding part 80Y and the elastic layer 62 into which the protruding part 80Y cuts, a slight outer gap 107 that approaches the shaft 61B occurs on a side where the inner inclined surface 82*a* is present and a slight inner gap 108 that approaches the shaft 61B also occurs on a side where the outer inclined surface 83*a* is present as illustrated in FIG. 14B. In this case, an electric path leading to an outside of the roll is easily formed by the outer gap 108. Furthermore, since the inner gap 107 is also a gap that approaches the shaft 61B, there is a risk of occurrence of discharge that flows between the outside of the roll and the shaft 61B while passing the outer gap 108 and then the inner gap 107.

Figure 15A:
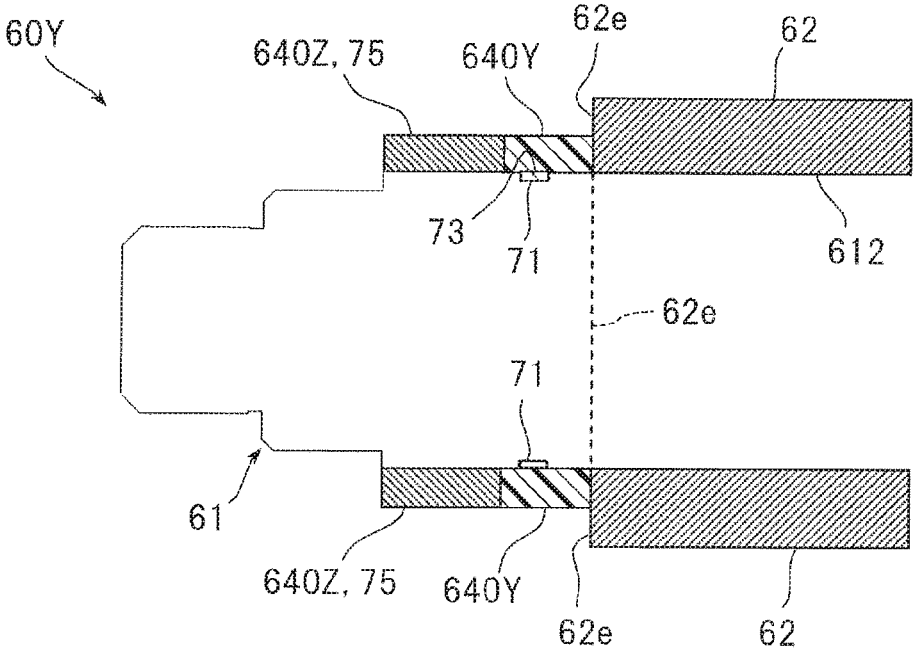
FIGS. 15A and 15B are schematic cross-sectional views illustrating a configuration of an annular member in a second transfer roll according to a second comparative example and a state during occurrence of discharge.

For reference, it has been confirmed that the following trouble occurs, for example, in a case where a roll 60Y according to a second comparative example illustrated in FIG. 15A is applied as the second transfer roll 351.

The second transfer roll 351 is a roll having a structure such that an annular member for comparison divided into a first annular member 640Y having an annular shape on which the protruding part 80 and the fixed part 73 are provided and a second annular member 640Z having an annular shape configured as the press-fitted part 75 is used instead of the annular member 64B, and the annular member is attached so that the first annular member 640Y is in contact with one end of the shaft 61 in a state where the protruding part 80 cuts into the end surface 62*e* of the elastic layer 62 and the second annular member 640Z is in contact with the first annular member 640Y.

That is, in a case where the roll 60Y according to the second comparative example is used as the second transfer roll 351 to which a voltage for second transfer of approximately 5 kV to 7 kV is supplied, discharge sometimes occurs after elapse of a certain period (e.g., 100 hours or longer).

Figure 15B:
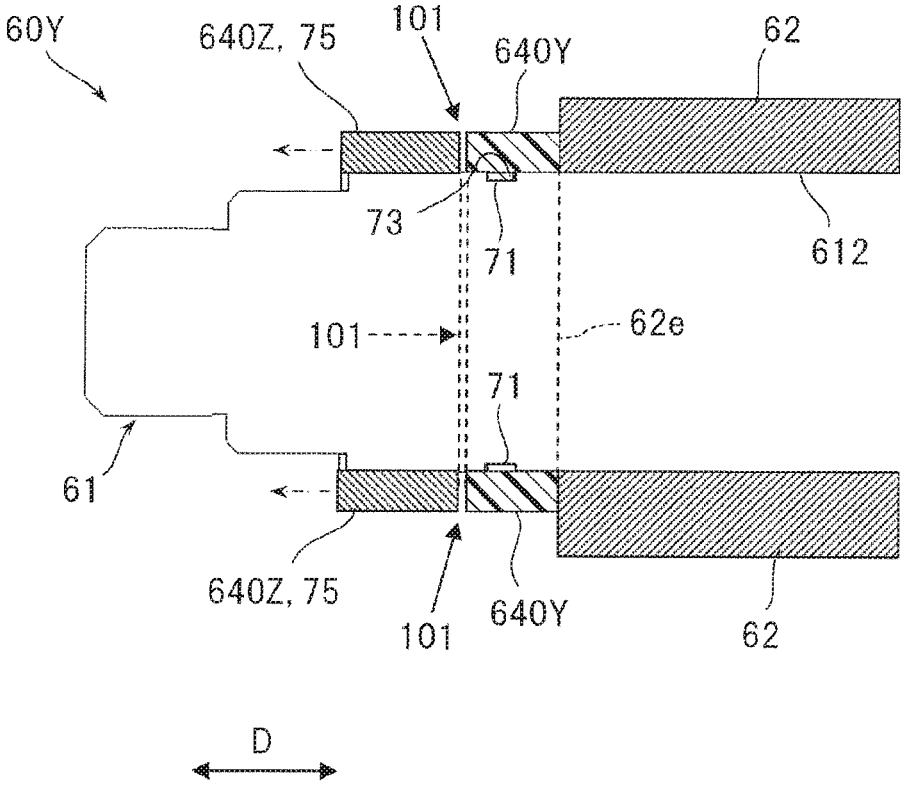

As a result of examination of the roll 60Y that caused the discharge, it has been confirmed that a small gap 101 reaching the shaft 61 is present between the first annular member 640Y and the second annular member 640Z as illustrated in FIG. 15B. This gap 101 is considered to have occurred because the second annular member 640Z is slightly deviated in the shaft direction D away from the first annular member 640Y as illustrated in FIG. 15B.

In the roll 60Y, no gap is present between the first annular member 640Y and the end surface 62*e* of the elastic layer 62.

In this respect, in a case where the annular member 64B having an integral structure according to the second exemplary embodiment is applied, there is no risk of occurrence of a gap 101 (FIG. 15B) unlike the roll 60Y according to the second comparative example.

Modifications

The present disclosure is not limited to the contents illustrated in the first and second exemplary embodiments and can be changed in various ways without departing from the spirit of the disclosure described in the claims. Therefore, the present disclosure encompasses the modifications illustrated below.

In the annular member 64 according to the first exemplary embodiment, the protruding part 80B having a tapered shape according to the second exemplary embodiment may be provided instead of the protruding part 80. Conversely, in the annular member 64B according to the second exemplary embodiment, the protruding part 80 having an almost rectangular cross section according to the first exemplary embodiment may be provided instead of the protruding part 80B.

In the annular members 64 and 64B of the rolls 6 and 6B according to the first and second exemplary embodiments, the press-fitted part 75 may be omitted.

In a case where the press-fitted part 75 is omitted, it is desirable to employ a configuration for preventing movement (rotation) in a circumferential direction of the shaft 61 or 61B to which the annular member 64 or 64B is attached. Examples of the configuration for preventing the movement in the circumferential direction include a configuration in which the fixing part 71 has a shape (a shape that almost matches the fixed part 73) that prevents movement in the circumferential direction of the fixed part 73 and the configuration in which a stick-shaped member for stopping rotation is inserted into a groove along the shaft direction D provided both on the shaft 61 or 61B and the annular member 64 or 64B.

In the shafts 61 and 61B and the annular members 64 and 64B of the rolls 6 and 6B according to the first and second exemplary embodiments, the fixing part 71 and the fixed part 73 may be omitted.

In a case where the fixing part 71 and the fixed part 73 are provided, it is desirable to employ a configuration for preventing movement (deviation) of the annular member 64 or 64B in the shaft direction D in the shaft 61 or 61B to which the annular member 64 or 64B is attached. Examples of the configuration for preventing the movement include a configuration in which the press-fitted part 75 is provided as illustrated in the first and second exemplary embodiments, a configuration in which a protrusion that prevents movement in the shaft direction D while being in contact with an end of the annular member 64 or 64B opposite to an end that makes contact with the end surface 62*e* of the elastic layer 62 is provided on the large-diameter part 612 or the small-diameter part 613 of the shaft 61 or 61B, and a configuration in which a fixing member (e.g., E-ring) attached so as to be fixed to the large-diameter part 612 or the small-diameter part 613 of the shaft 61 or 61B while being in contact with the opposite end of the annular member 64 or 64B is used.

The roll 6 or the like according to the present disclosure may be configured such that the annular member 64 or 64B is attached to one of the ends 61*a* and 61*b* of the shaft 61 or 61B. The roll 6 or the like according to the present disclosure may be configured such that the surface layer 63 is not provided. In a case where the surface layer 63 is provided, the projecting part 63*e* of the surface layer 63 may be omitted.

The roll 6 or the like according to the present disclosure is not limited to a case where the roll 6 or the like is applied to the second transfer roll 351 and can be applied as another roll in which a voltage that can cause discharge is supplied to the shaft 61. Examples of the other roll include a first transfer roll, a charging roller, a second transfer opposing roll, and a development roller provided with an elastic layer.

Furthermore, an image forming apparatus to which the roll 6 or the like according to the present disclosure is applied need just be an image forming apparatus to which the roll 6 or the like according to the present disclosure is applicable, and a form, a kind, an image formation method, and the like of the image forming apparatus are not limited in particular.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A roll comprising:

an electrically-conductive shaft;

an elastic layer provided on the shaft; and a non-electrically-conductive annular unit that is attached to at least one of ends of the shaft that protrude from end surfaces of the elastic layer in a shaft direction while being in contact with the end surface of the elastic layer, wherein a protruding part that protrudes so as to cut into the end surface of the elastic layer is provided on a part of the annular unit that makes contact with the end surface of the elastic layer, and the protruding part has a thickness smaller than a thickness of the part of the annular unit that makes contact with the end surface of the elastic layer.

2. The roll according to claim 1, wherein the protruding part is configured as a protruding part that has a shape continuous in an annular manner.

3. The roll according to claim 2, wherein the protruding part is provided so as not to be in contact with the shaft.

4. The roll according to claim 3, wherein the protruding part is configured such that a surface thereof that faces the shaft is an inclined surface that gradually separates away from the shaft in a direction in which the protruding part protrudes.

5. The roll according to claim 4, wherein a thickness of the protruding part is equal to or smaller than ½ of the thickness of the part of the annular unit that makes contact with the end surface of the elastic layer.

6. The roll according to claim 3, wherein a thickness of the protruding part is equal to or smaller than ½ of the thickness of the part of the annular unit that makes contact with the end surface of the elastic layer.

7. The roll according to claim 2, wherein a thickness of the protruding part is equal to or smaller than ½ of the thickness of the part of the annular unit that makes contact with the end surface of the elastic layer.

8. The roll according to claim 1, wherein the protruding part is provided so as not to be in contact with the shaft.

9. The roll according to claim 8, wherein the protruding part is configured such that a surface thereof that faces the shaft is an inclined surface that gradually separates away from the shaft in a direction in which the protruding part protrudes.

10. The roll according to claim 9, wherein a thickness of the protruding part is equal to or smaller than ½ of the thickness of the part of the annular unit that makes contact with the end surface of the elastic layer.

11. The roll according to claim 8, wherein a thickness of the protruding part is equal to or smaller than ½ of the thickness of the part of the annular unit that makes contact with the end surface of the elastic layer.

12. The roll according to claim 1, wherein a thickness of the protruding part is equal to or smaller than ½ of the thickness of the part of the annular unit that makes contact with the end surface of the elastic layer.

13. The roll according to claim 1, wherein a part of the ends of the shaft to which the annular unit is attached is a stepped part constituted by a small-diameter part and a large-diameter part;

the annular unit is a two-step shaped unit that has a small-diameter part and a large-diameter part that are attached to the small-diameter part and the large-diameter part of the stepped part of the shaft, respectively; and the protruding part is provided on the large-diameter part of the annular unit that makes contact with the end surface of the elastic layer.

14. An image forming apparatus comprising:

a roll including an electrically-conductive shaft; an elastic layer provided on the shaft; and a non-electrically-conductive annular unit that is attached to at least one of ends of the shaft that protrude from end surfaces of the elastic layer in a shaft direction; and a power feeding unit that supplies a voltage to the shaft of the roll, wherein the roll is the roll according to claim 1.

* * * * *